United States Patent [19]

Owen

[11] Patent Number: 4,699,312

[45] Date of Patent: Oct. 13, 1987

[54] BALLOT BOX AND COUNTER DISPLAY

[76] Inventor: Richard A. Owen, 2704 Rohlwing Rd., Rolling Meadows, Ill. 60008

[21] Appl. No.: 891,565

[22] Filed: Aug. 1, 1986

[51] Int. Cl.[4] ..... A47F 5/11

[52] U.S. Cl. ..... 232/2; 229/112; 232/43.1; 248/459

[58] Field of Search ..... 232/43.1, 2; 229/112; 248/174, 459

[56] References Cited

U.S. PATENT DOCUMENTS

| | | | |
|---|---|---|---|
| 1,673,769 | 6/1928 | Graham | 232/2 X |
| 1,675,060 | 6/1928 | Simmons | 248/459 X |
| 2,783,013 | 2/1957 | Williamson | 248/459 X |
| 4,330,102 | 5/1982 | Gebhardt et al. | 248/459 |

FOREIGN PATENT DOCUMENTS

| | | | |
|---|---|---|---|
| 1097283 | 3/1981 | Canada | 229/112 |

*Primary Examiner*—Robert W. Gibson, Jr.
*Attorney, Agent, or Firm*—Charles F. Lind

[57] ABSTRACT

The disclosed ballot box and counter display has fixed front, rear, top and side walls; and has a bottom wall hinged to the rear wall, to be opened and closed. The top wall has an inner top wall panel hinged to the upper edge of one side wall and extended to the opposite side wall, and an outer top wall panel hinged along its rear edge to the upper edge of the rear wall panel and adapted to overlie the inner top wall panel. A flap hinged to the upper edge of the other side wall may underlie the inner top wall panel, and a flap hinged to the inner top wall panel may be fitted through slot means in this other side wall flap, for support of the inner top wall panel. A front wall outer panel is hinged at its upper front edge to the lower front edge of the front wall outer panel, and a flap on the lower edge of the outer front wall panel is folded around the lower edge of the front wall and fitted between the adjacent side walls. The top wall is sloped downwardly from the rear wall to the front wall, and a ballot receiving slot is formed in the top wall. A display panel may be supported by the box. A tab on the bottom wall panel at the front edge thereof may cooperate with a shoulder adjacent the lower edge of the front wall to lock the bottom wall in the closed position.

16 Claims, 8 Drawing Figures

BALLOT BOX AND COUNTER DISPLAY

FIELD OF THE INVENTION

This invention relates to a ballot box and counter display of the type having a top surface for holding and/or signing the ballots, having a slotted opening to receive ballots or the like, and also having closure means that can be opened to provide access to the ballots contained in the box.

BACKGROUND OF THE INVENTION

Existing containers, of the type generally known and used as a ballot box and counter display, generally define an enclosure having a top surface for holding and/or signing the ballots, a slotted opening in the top surface to receive ballots, and closure means that can be opened to provide access to the contained ballots and reclosed for subsequent reuse. Of importance with such a container is the ability to ship the same flat, as a blank; and to set the container up from the blank, with easily understood instructions and without complications. Also, when set up, the container must provide adequate support and strength, to allow it to be subjected to normal and even abusive use, while yet retaining its overall original shape and appearance.

While reference will be made to the subject as a ballot box, the box will of course be available for use with any form of registration blanks, cards, ticket stubs or the like, that may commonly be collected for a give-away drawing and/or for providing names for follow-up informational or sales efforts.

SUMMARY OF THE INVENTION

The present invention provides a ballot box and counter display having a reinforced top surface for holding and/or supporting the ballots when completing them, the top surface having a slotted opening to receive ballots; and also having closure means that can be opened to provide access to the contained ballots and closed for subsequent reuse.

BRIEF DISCRIPTION OF THE DRAWINGS

Features of the present invention, and its advantages, will appear from the following written disclosure, and from the accompanying drawings, in which:

FIG. 1 is a perspective view of a first embodiment of the ballot box and counter display forming this invention;

FIGS. 2 and 3 are fragmentary sectional views, taken generally along lines 2—2 and 3—3, respectively in FIG. 1;

DETAILED DESCRIPTION OF ILLUSTRATED EMBODIMENTS

Figure 1:
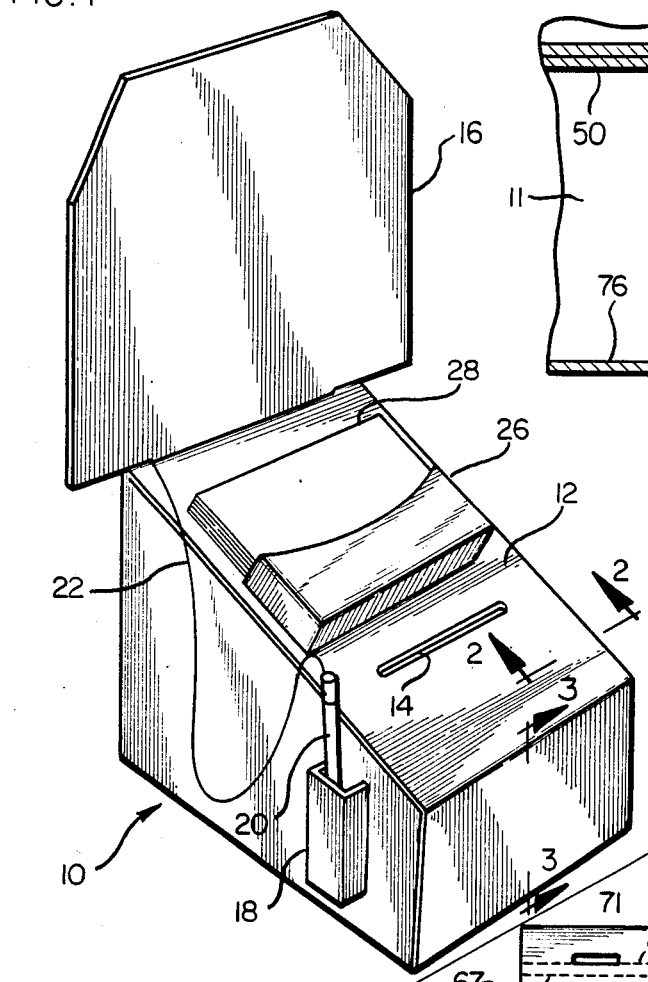
Figure 2:
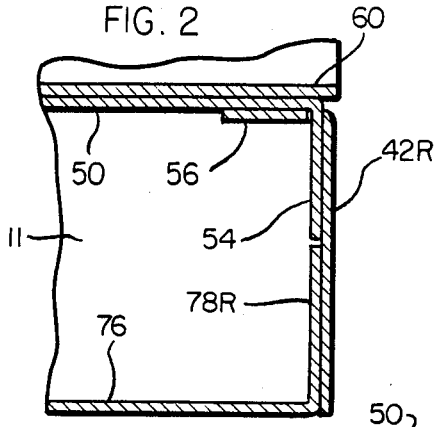

FIG. 1 illustrates a first embodiment of the improved ballot box and counter display 10, the same having opposed pairs of walls with respective adjacent edges contiguous to one another to define an enclosure 11. The outer top surface 12 of the box is sloped downwardly from the upper rear box edge, to offer a writing surface for filling out and signing the ballots, registration forms or the like to be used with the ballet box 10. A slot 14 is formed in the top surface 12 to allow for the deposit of the completed ballots or forms.

A display panel 16 may upstand from the box 10 adjacent the rear upper edge thereof. Top-open holder 18 may be mounted on the side of the box to support a marking instrument, such as a pencil or pen 20; and tethering line 22 may be connected between the writing instrument 20 and the display panel 16, the line being fitted through one of the holes 24 (see FIG. 4) in the panel blank 32 and tied. A top-open holder 26 may also be mounted on the top surface 12 for containing several non-completed ballots 28 to be used with the box.

Figure 4:
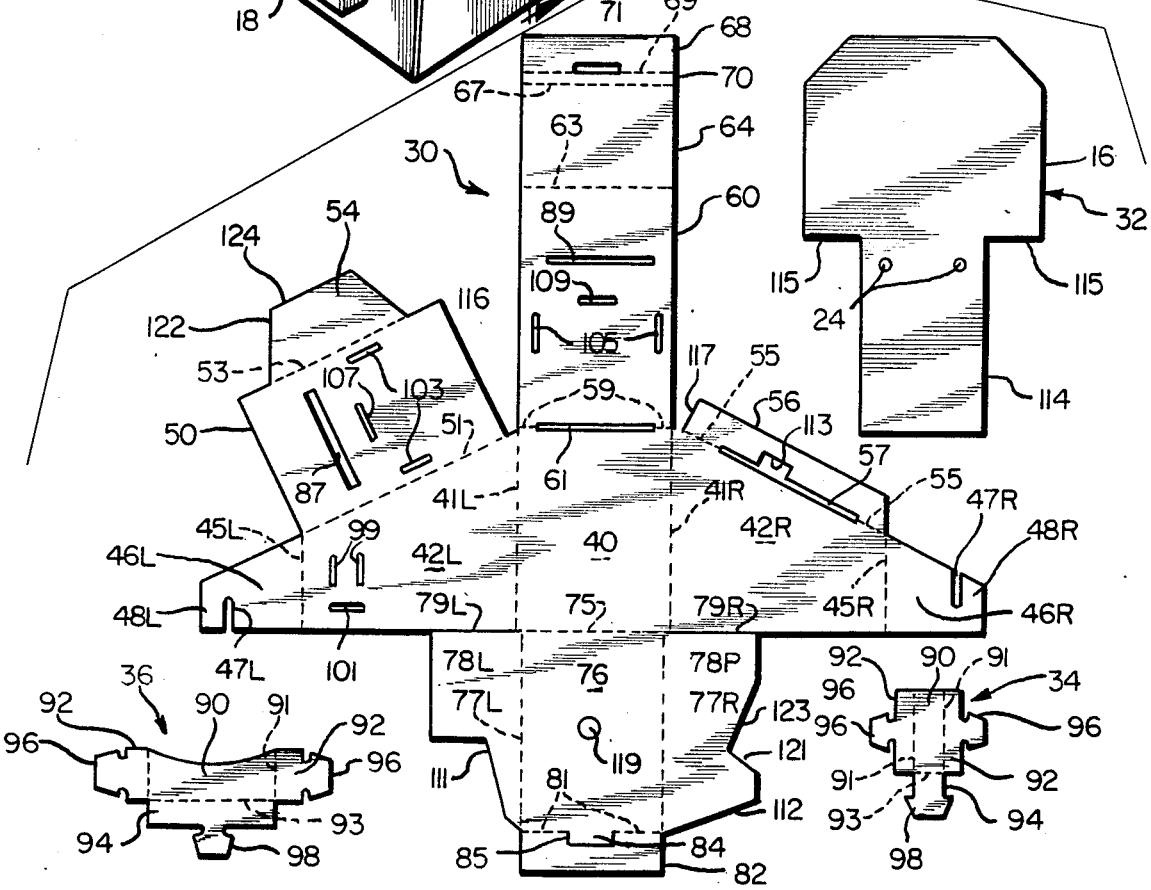
FIG. 4 is a plan view of the blank, shown flat, used to form the ballot box and counter display of FIG. 1.

As illustrated in FIG. 4, a flat main blank 30, appropriated cut and scored, may be folded from the flat, to form the box 10; and separate blanks 32, 34 and 36 may be nested off of the main blank 30 near the corners thereof to form respectively, the display panel 16, writing instrument holder 18, and ballot holder 26.

The main box blank 30 has a rear wall panel 40. Side wall panels 42R and 42L may be hinged across score lines 41R and 41L off of the side edges of the rear wall panel 40. Inner front wall flaps 46R and 46L may be hinged across score lines 45R and 45L off of the front edges of the side wall panels 42L and 42R. Oppositely open grooves 47R and 47L may be formed in the inner front wall flaps 46R and 46L to define downwardly and upwardly projected locking tabs 48R and 48L, respectively. Inner top wall panel 50 may be hinged across score line 51 off of the upper edge of side wall panel 42L. Tuck-in flap 54 may be hinged across score line 53 off of the inner top wall panel 50, the score line 53 being parallel to and along the panel edge opposite from the score line 51. Inner flap 56 may be hinged across separated score lines 55 off of the upper edge of the other side wall panel 42R; slot-like opening 57 being formed in the panel 56 between the score lines 55 and adjacent the side wall panel 42R.

Outer top wall panel 60 may be hinged across spaced score lines 59 off of the top edge of the rear wall panel 40; slot-like opening 61 being formed in the panel 60 somewhat between the score lines 59. Outer front wall panel 64 may be hinged across score line 63 off of the front edges of the outer top wall panel 60. Inner front wall flap 68 and small wrap panel 70 may be hinged across closely spaced score lines 67 and 69 off of the bottom edge of the outer front wall panel 64; and slot-like opening 71 may be formed in the panel 68 adjacent the score line 69.

Bottom wall panel 76 may be hinged across score line 75 off of the bottom edge of the rear wall panel 40. Side tuck-in flaps 78R and 78L may be hinged across score line 77R and 77L off of the side edges of the bottom wall panel 76, being separate from the respective side wall panels 42L and 42R, by cut lines 79R and 79L. Front tuck-in flap 82 may be hinged across spaced score lines 81 off of the front edge of the bottom wall panel 76. A locking tab 84, separated from the front tuck-in flap 82 by C-shaped cut line 85 extended between the ends of the spaced score lines 81, may be formed as a rigid extension of the bottom wall panel 76.

Figure 5:
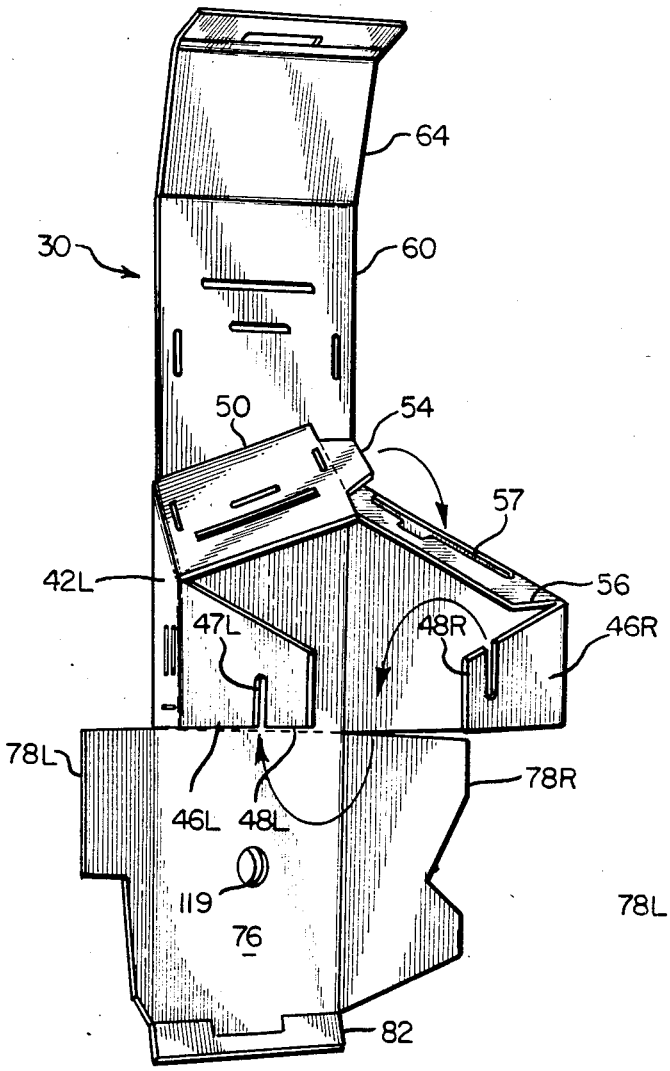
FIGS. 5, 6 and 7 are perspective views of the ballot box and counter display of FIG. 1, shown in a various conditions of assembly of the same.
Figure 6:
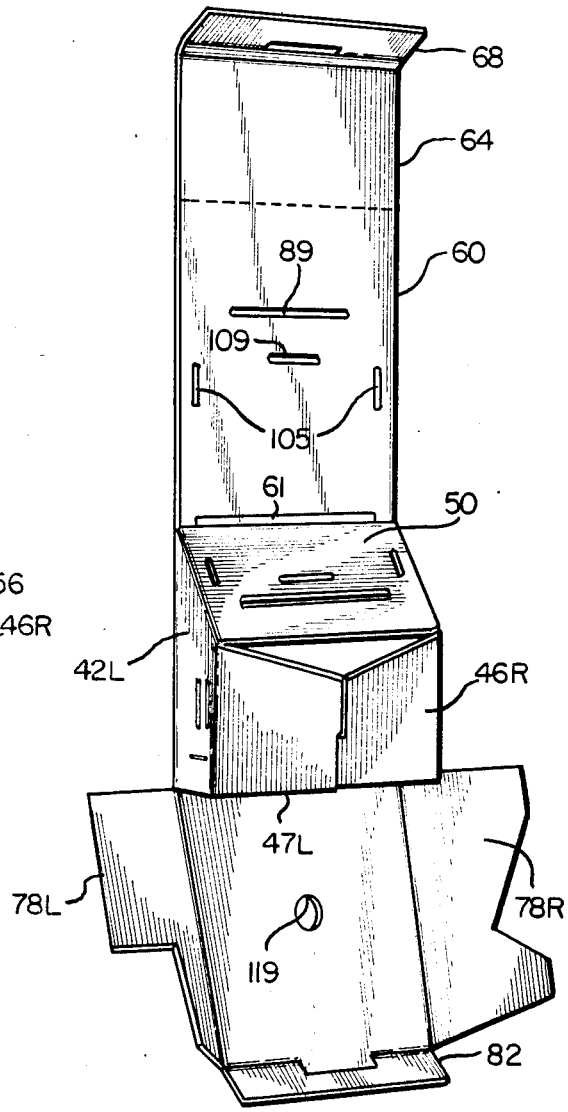

To set up the box 10 (see FIGS. 5 and 6), the side wall panels 42R and 42L may be folded approximately normal to the rear wall panel 40, the inner front wall flaps 46R and 46L may be folded approximately normal to the side wall panels, and the tabs 48R and 48L may be overlapped and interfitted within the respective grooves 47L and 47R to interconnect the flaps 46R and 46L together. This defines an open-ended sleeve formed by the rear wall panel 40, the side wall panels 42R and 42L, and the inner front wall flaps 46R and 46L; and the tabs 48R and 48L lie against the inner front wall flaps on the inside of the sleeve. The inner top wall panel 50 and inner flap 56 may then be folded across the open top of the sleeve, the inner flap 56 being against and underlying the inner top wall panel 50. Tuck-in flap 54 may then be inserted through the slotted opening 57 in inner flap 56, and may be against the inside of the side wall panel 42R. This squares up the sleeve to the condition illustrated in FIG. 6.

Figure 7:
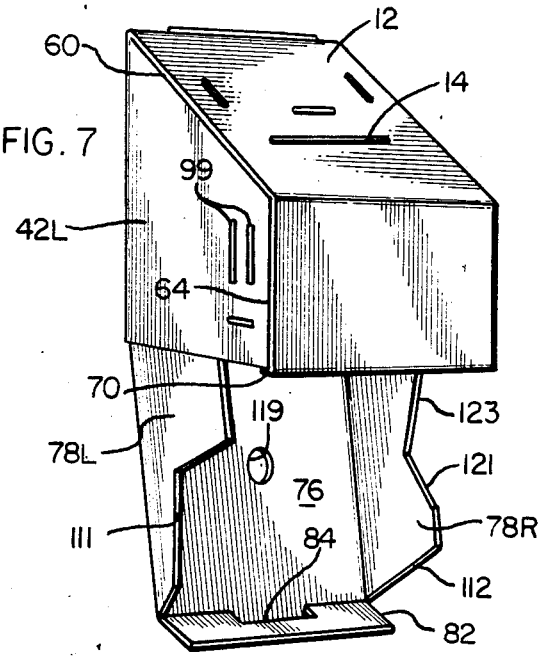

The outer top wall panel 60 may then be folded to lie against inner top wall panel 50; the outer front wall panel 64 may be folded to lie against the outside of the inner front wall flaps 46R and 46L; and the inner front wall flap 68 may be folded almost 180 degrees into the sleeve to lie against the inside of the front wall flaps 42R and 42L. The inner front wall flap 68 may be sized to have its side edges wedged somewhat snuggly between the side wall panels 42R and 42L, to hold the structure together as assemblied. This assemblied condition is illustrated in FIG. 7, with the bottom wall panel 76 yet being open; and may also represent the condition of the defined box when emptying it of its contents.

The bottom wall panel 76 may be closed by folding it about score line 75 to lie across the bottom of the defined sleeve; but the side tuck-in flaps 78R and 78L and the front tuck-in flap 82 are first folded about their respective score lines 77R, 77L and 81, to be approximately normal to the bottom panel 76, and are inserted into the sleeve, to lie against the inside of the side wall panels 42R and 42L and the inner front wall flap 68 respectively. When the bottom wall is fully closed, the locking tab 84 may fit into the opening 71 of the inner front wall flap 68, abutting a shoulder defined by the wrap panel 70 at the lower edge of the front wall, operable to hold the bottom wall panel 76 closed.

To define the deposit slot 14, the inner top panel 50 and the outer top panel 60 respectively, may have formed therein elongated openings 87 and 89, which register with one another when the panels 50 and 60 are properly overlapped and the box is in its assemblied condition.

Each of the holders 18 and 26 may have a similar construction (differing only in the sizes and proportions), being formed from the blanks 34 and 36 respectively, as has been noted earlier. Specifically, each blank 34 (or 36) may include a face panel 90, and side and bottom panels 92 and 94 respectively hinged across score lines 91 and 93 off of the sides and bottom of the face panel 90. The side and bottom panels 92 and 94 each may further have T shaped locking tabs 96 and 98 formed as integral rigid extensions of the panels.

To receive and hold the T-shaped tabs 96 and 98 of the holders, the respective side or top wall panels of the main blank 30 may have slotted openings formed therein that alone receive the tabs or that come in registry with one another to receive the tabs. Thus, openings 99 and 101 in side wall panel 42L alone receive the side and bottom wall tabs 96 and 98 respectively of the holder 18; while registered openings 103, 105 and 107, 109 in inner top wall panel 50 and in outer top wall panel 60 respectively, receive the side locking tabs 96 and bottom locking tabs 98 of the holder 26.

The edge 111 of the bottom wall side flap 78L may be cut away to be clear of the side wall openings 99 and 101 (and the tabs 96 and 98 of the holder 18 inserted therein), allowing the flap 78L to be moved into and/or from the inside of the box, upon the bottom wall closure including panel 76 and flap 78L being opened and/or closed. The edge 112 of the bottom wall side flap 78R may be cut away at an angle from being normal to the score line 77R, to clear the upper front corner of the box upon the bottom wall closure being opened and/or closed.

It may be necessary to form opening 113 in the inner top wall flap 56 (such as off of the opening 57) to be in registry with one each of the openings 103 and 105, for allowing the insertion of one of the locking tabs 96 for the holder 26 into such openings.

The display blank 32 may have the display panel 16 of any size; and a tongue 114 may be formed as a rigid integral extension of the display panel 16 and sized to fit within the opening 61 in the outer top wall panel 60. Edges 115 of the display blank may rest on the upper edge of the box, and the tongue may be just about the same length as the height of the rear wall panel 40. The upper edges 116 and 117 of the inner top wall panel 50 and flap 56 respectively, may be spaced somewhat from the score line 59, to be spaced from the upper corner of the box and allow for the insertion of the display panel tongue 114 into the box.

An opening 119 may be formed in the bottom wall panel 76, sized to receive a person's finger (not shown), to allow the panel to be pulled out to open the bottom closure panel of the box 10.

The score lines 69, 67, 63, 59, 75 and 81 may be parallel to one another; the score lines 45L, 41L, 41R and 45R may be parallel to one another; and the score lines of each of the above respective groups may be perpendicular to one another. The score lines 51 and 55 should be angled the same relative to these other score lines, to have the box shaped symetrically and the to surface 12 slope downwardly; and the degree of angle determines the downward slope of the top surface 12. In this regard, a downward slope of the order of 20–40 degrees relative to the closed bottom wall may be desirable; whereby the included angle between the score lines 51 and 55, and 41R and 41L will be the complement of this, or 70–50 degrees.

Figure 3:
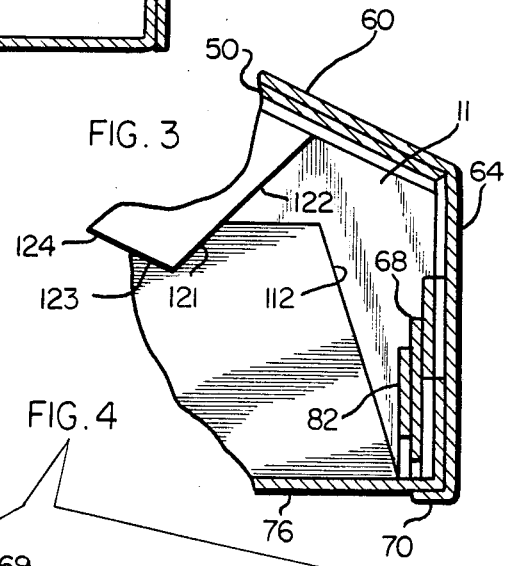

The free edges 121 and 123 of the tuck-in flap 78R may be trimmed to abut the free edges 122 and 124 respectively, of the tuck-in flap 54, in the closed position of the box (as illustrated in FIG. 3). This edge-to-edge fit of the flaps 54 and 78R prevents the bottom wall 76 from being pushed into the box beyond its closed position, and may also increase the load-carrying capacity of the closed inner top wall panel 50, at the side wall 42R, when the box is in normal use.

Figure 8:
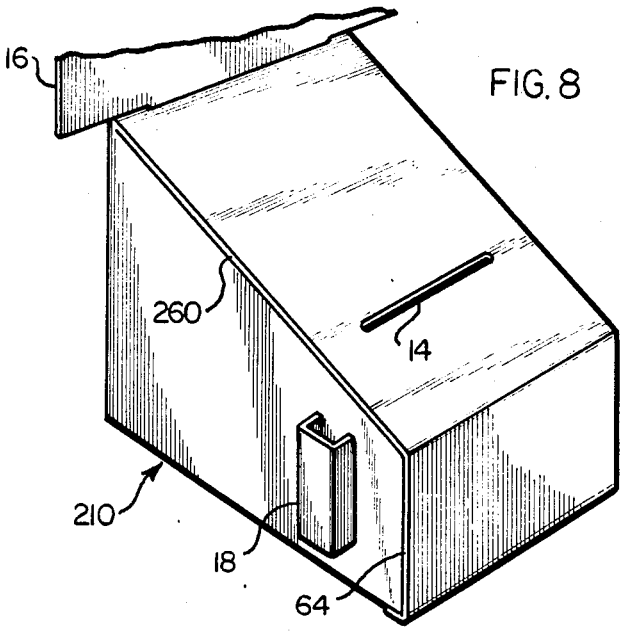
FIG. 8 is a perspective view of a second illustrative embodiment of the ballot box and counter display of this invention.

FIG. 8 shows a second embodiment of the ballot box and counter display 210 that does not have any holder 26 for the ballots; but otherwise in all respects may be the same as the first embodiment, and corresponding components in this embodiment are referenced in the same manner. Openings 105 and 109 in the outer top panel 60 of the first disclosed embodiment may be eliminated, with the box 210 having outer top panel 260; and possibly also the openings 103 and 107 in the inner top wall panel 50, and opening 111 in the inner flap 56 may be eliminated (neither panel or flap being specifically illustrated in FIG. 8).

It may be appreciated that the disclosed ballot box and counter display 10 (or 210) can be economically fabricated as well-nested blanks 30, 32, 34 and 36; can be shipped flat as the blanks and easily set up as the box; can be attractive and durable in use; can be opened easily to provide access to the contents, can be reliably reclosed for subsequent reuse; and can even be broken down to the blanks for flat shipment and/or storage, and later reuse. Moreover, the disclosed ballot box and counter display 10 (or 210) is strong . . . having the top wall comprised of the overlapped inner and outer panels 50 and 60, and having the full edge support of the panels by and at the upper edges of the side, front and rear wall of the box. The top surface 12 (or 212) may thus be written on in completing the forms or ballots to be used with the box, without deforming the box. The box 10 (210) is structurally strong even with the bottom wall closure means opened; while the bottom wall locking tab 84 prevents the box from accidentally being opened, such as during handling of the same. The continuous or hinged outer top wall panel 60 (or 260) and outer front wall panel 64 provides for good graphics of display and neatness of construction of the box.

What is claimed is:

1. A ballot box and counter display, comprising the combination of opposed front and rear walls, bottom and top walls, and side walls, having respective edges contiguous to one another to define an enclosure;

the top wall including overlapped inner and outer panels having slot opening means formed therethrough and in registry;

the inner top wall panel being hinged along one side edge to the upper edge of one of the side walls, and having its opposite side edge extended substantially to the upper edge of the other of the side walls;

the outer top wall panel being hinged along its rear edge to the upper edge of the rear wall, and having its opposite front edge extended to the upper edge of the front wall;

the front wall including inner flaps and an outer panel;

the inner front wall flaps being hinged off of the front edges of the side walls;

the outer front wall panel being hinged at its upper front edge to the lower front edge of the outer top wall panel;

flap means on the lower edge of the outer front wall panel adapted to be folded around the lower edge of the front wall and be fitted between the adjacent side walls; and the bottom wall having a panel hinged to the rear wall at bottom edge thereof, and the side and front edges of the bottom wall being separate from the respective side and front walls, adapted to allow the bottom wall to be opened and closed to provide access to the box enclosure.

2. A ballot box and counter display according to claim 1, further wherein the top wall slopes downwardly at a slight angle relative to the bottom wall, to provide a surface on which one may write to complete the ballot to be used with the box.

3. A ballot box and counter display according to claim 1, further including flap means hinged to the upper edge of the other side wall and folded to underlie the inner top wall panel.

4. A ballot box and counter display according to claim 1, further including interfitting tab and groove means formed on the inner front wall flaps operable to overlap and interconnect the flaps together.

5. A ballot box and counter display according to claim 1, further including tab means on the bottom wall panel at the front edge thereof adapted to cooperate with a shoulder formed adjacent the lower edge of the front wall to lock the bottom wall in the closed position.

6. A ballot box and counter display according to claim 5, wherein further including flap means on the side and front edges of the bottom wall panel adapted to be inserted into the box as defined and to lie against the inside of the respective side and front side walls.

7. A ballot box and counter display according to claim 1, further wherein the flap means hinged to the upper edge of the other side wall has slot means formed therein adjacent the other side wall, and flap means hinged to the opposite side edge of the inner top wall panel and adapted to be fitted through said slot means in the other side wall flap means and into the box as defined and to lie against the other side wall.

8. A ballot box and counter display according to claim 7, further including interfitting tab and groove means formed on the inner front wall flaps operable to overlap and interconnect the flaps together.

9. A ballot box and counter display according to claim 8, further including flap means on the side and front edges of the bottom wall panel adapted to be inserted into the box as defined and to lie against the inside of the respective side and front side walls, and tab means on the bottom wall panel at the front edge thereof adapted to cooperate with a shoulder formed adjacent the lower edge of the front wall to lock the bottom wall in the closed position.

10. A ballot box and counter display according to claim 8, further wherein the flap means on the bottom wall panel and the flap means hinged to the opposite side edge of the inner top wall panel have edge surfaces adapted to abut one another when the bottom wall panel is closed.

11. A ballot box and counter display, comprising the combination of opposed front and rear walls, bottom and top walls, and side walls, having respective edges contiguous to one another to define an enclosure;

the bottom wall, the rear wall, and the side walls each consisting of a respective panel, and said bottom and side wall panels being hinged to the rear wall at respective bottom and side edges thereof;

the top wall including overlapped inner and outer panels having slot opening means formed therethrough and in registry;

the inner top wall panel being hinged along one side edge to the upper edge of one of the side wall panels, and having its opposite side edge extended substantially to the upper edge of the other of the side walls;

the outer top wall panel being hinged along its rear edge to the upper edge of the rear wall panel, and having its opposite front edge extended to the upper edge of the front wall;

the front wall including inner flaps and an outer panel;

the inner front wall flaps being hinged off of the front edges of the side wall panels;

the outer front wall panel being hinged at its upper front edge to the lower front edge of the outer top wall panel;

flap means on the lower edge of the outer front wall panel adapted to be folded around the lower edge of the front wall and be fitted between the adjacent side walls;

the top wall being sloped downwardly at a slight angle relative to the bottom wall, to provide a surface on which one may write to complete the ballot to be used with the box; and the side and front edges of the bottom wall being separate from the respective side and front walls, adapted to allow the bottom wall to be opened and closed to provide access to the box enclosure.

12. A ballot box and counter display according to claim 11, further including flap means hinged to the upper edge of the other side wall panel adapted to underlie the inner top wall panel, and the flap means having slot means formed therein adjacent the other side wall panel, and flap means hinged to the opposite side edge of the inner top wall panel and adapted to be fitted through said slot means in the other side wall flap means to lie against the other side wall panel.

13. A ballot box and counter display according to claim 12, further includung flap means on the side and front edges of the bottom wall panel adapted to be inserted into the box as defined and to lie against the inside of the respective side and front side walls, wherein the flap means on the bottom wall panel and the flap means hinged to the opposite side edge of the inner top wall panel have edge surfaces adapted to abut one another when the bottom wall panel is closed.

14. A ballot box and counter display according to claim 13, further including tab means on the bottom wall panel at the front edge thereof adapted to cooperate with a shoulder formed adjacent the lower edge of the front wall to lock the bottom wall in the closed position.

15. A ballot box and counter display according to claim 14, further including a display panel having tongue means, and means including an opening in the top wall of the box for inserting the tongue means for supporting the display panel relative to the box.

16. A ballot box and counter display according to claim 14, further including holder means having a face panel and side and bottom panels hinged off of the face panel, locking tabs formed on the ends of the side and botton panels, and means including openings in the side wall panel of the box for receiving the locking tabs for supporting the holder means relative to the side wall of the box.

* * * * *